US006354729B1

(12) United States Patent
Brown

(10) Patent No.: US 6,354,729 B1
(45) Date of Patent: Mar. 12, 2002

(54) MIXING APPARATUS

(75) Inventor: Christopher John Brown, Derbyshire (GB)

(73) Assignee: Tecexec Limited, Derbyshire (GB)

( * ) Notice: Subject to any disclaimer, the term of this patent is extended or adjusted under 35 U.S.C. 154(b) by 0 days.

(21) Appl. No.: 09/402,943

(22) PCT Filed: Apr. 7, 1998

(86) PCT No.: PCT/GB98/01027

§ 371 Date: Mar. 27, 2000

§ 102(e) Date: Mar. 27, 2000

(87) PCT Pub. No.: WO98/46341

PCT Pub. Date: Oct. 22, 1998

(30) Foreign Application Priority Data

Apr. 11, 1997 (GB) ..... 9707395

(51) Int. Cl.[7] ..... B01F 5/06; B01F 7/10; B01F 7/26

(52) U.S. Cl. ..... 366/304; 366/305; 366/307; 366/316

(58) Field of Search ..... 366/315, 316, 366/317, 325.2, 303, 304, 305, 306, 307

(56) References Cited

U.S. PATENT DOCUMENTS

| | | | |
|---|---|---|---|
| 2,280,272 | A | 4/1942 | Sullivan |
| 3,194,540 | A | 7/1965 | Hager |
| 4,564,333 | A | 1/1986 | Timby et al. |

FOREIGN PATENT DOCUMENTS

| | | |
|---|---|---|
| DE | 19539136 | 2/1996 |
| DE | 19516578 | 4/1996 |
| GB | 2100138 | 12/1982 |
| GB | 2308076 | 6/1997 |
| JP | 57018488 | 1/1982 |

*Primary Examiner*—Tony G. Soohoo
(74) *Attorney, Agent, or Firm*—Woodard, Emhardt, Naughton, Moriarty & McNett

(57) ABSTRACT

A process and apparatus for the mixing of material by means of the combination of sheer-dispersion and/or extensional-dispersion and distributive mixing actions, in which the mixing occurs in one or more stages within stress inducing flow channels between movable members whereby the material is essentially propelled through the flow channels of such stages by pumping actions provided by the relative movement between the members within the mixer itself.

33 Claims, 5 Drawing Sheets

MIXING APPARATUS

The present invention relates to a mixing apparatus.

The operation of mixing is generally understood to comprise two distinct actions; dispersive mixing and distributive mixing. In dispersive mixing the individual parts of the materials being mixed, whether solid or fluid, have their respective geometries altered by means of applied stresses. This usually takes the form of reducing the average size of individual parts while increasing their numbers. In distributive mixing the individual parts of the materials, whether solid or fluid, are blended together in order to obtain a spatial uniformity in the distribution of the various material parts with respect to one another. A good mixing operation thus usually requires both dispersive and distributive mixing actions to occur.

Distributive mixing is primarily a function of the geometry of the mixing apparatus and known mixers typically fall into two general types providing either random or structured distributive mixing. Random distributive mixers achieve mixing by randomly agitating the materials and include known mixers such as tumble-blenders and ribbon-blenders. Structured-distributive mixers on the other hand achieve mixing by systematically repeating a geometrically controlled sequence of dividing, reorienting and rejoining the materials and include static mixers and cavity transfer mixers.

In contrast, dispersive mixing is primarily a function of forces, pressures, stresses and strains applied to the materials. In general, the size reduction of materials that is required in dispersive mixing is achieved by applying stresses to the materials. These applied stresses usually take the form of compressive, tensile or shear stresses. For mixing fluid materials the predominant method of stressing has been by means of applying shear, as this can readily be achieved by utilising the drag forces that exist within a fluid bounded by two relatively moving surfaces in a machine. Examples of such mixers include internal rotor/stator mixers in which the material is sheared between the rotor and the stator surfaces. Shear stressing can also be obtained by forcing a fluid material over one or more surfaces that do not have a motion relative to one another, for instance between the walls of a channel. In this case it is still possible to generate significant shear stresses in the fluid, but only at the expense of providing some form of pumping energy to propel the fluid over the surfaces. It has long been recognised however that an alternative mechanism, that of extensional flow, is capable of subjecting fluid materials to compressive and tensile stresses that in practice can be much higher than the shear stresses.

Extensional flow requires that the fluid be pressurised in order to propel it between surfaces that subject the fluid to tensile or compressive stresses. Such surfaces can be generally orientated in the direction of the flow in which case the flowing material is accelerated or decelerated along its flowpath by virtue of mass conservation, or generally orientated across the direction of the flow, in which case the flowing material is decelerated and thus compressed by virtue of the change in the momentum of the fluid, such as in impact. Known mixers designed to operate on the basis of extensional flows for dispersion have thus required external means of pressurisation in the form of high-pressure pumps located upstream (the same requirement for pumping applies to a mixer operating on the basis of shear flow between non-moving surfaces as mentioned above). Given that it is often a requirement that any given part of the material being mixed is subjected to a number of stressing cycles it is apparent that the overall pressures required to provide extensional flows and shear flows through a mixer can become prohibitively high. Additionally, the need to engineer such a mixer so as to ensure that the extensional flow and shear flow occur with maximum efficiency, i.e. the minimum pressure loss, is relatively costly.

It is an object of the present invention to provide a mixing apparatus which obviates or mitigates the above disadvantages.

According to the present invention there is provided a mixing apparatus for mixing a material, the apparatus comprising one or more flow channels and at least two members which are either eccentrically mounted one within the other so as to define a chamber therebetween, or axially mounted defining a chamber between facing surfaces thereof, and which are rotateable relative to one another to thereby produce a pumping force to force material through said flow channels and chamber to thereby subject the material to stresses within said flow channels and/or said chamber that result in extensional-dispersive and/or shear-dispersive mixing.

Preferably the apparatus is further adapted to subject the material to distributive mixing.

The mixer preferably comprises a plurality of said stress-inducing flow channels in at least two sets defined by respective channel members arranged such that material is pumped from channels of one set to channels of another.

Pumping force may be imparted to the material during and/or intermediate two sets of said stress-inducing flow channels.

The channels may have sides that are parallel, convergent or divergent relative to one another and any channel may be entirely contained within a single channel defining member of the mixer or alternatively may be formed within the surface of one channel member and bounded by the adjacent surface of any other component of the mixer (e.g. another channel defining member). The channels may be, for instance, radial channels within generally concentric members or axial channels within members juxtaposed in an axial direction.

Chambers are preferably provided between channel defining members of the mixer the chambers providing random-distributive and both shear-dispersive and extensional-dispersive mixing to the mixing components. The chambers may, for instance, be annular spaces between concentric or eccentric surfaces, or be axial spaces between surfaces that are parallel or not-parallel. The chambers may be sufficiently small so as to permit the channel members to come into contact.

The pumping actions may, for instance, arise from centrifugal forces or from drag forces, or may take the form of positive-displacement pumping such as vane pumping, gear pumping or piston pumping.

In preferred embodiments of the invention there is provided means to obtain an amount of backflow mixing, in which the direction of the flow within a channel (or chamber between sets of channels) is reversed during part of the pumping cycle as a result of a reversal in the direction of the pressure differential across the channel (or chamber). The amount of flow occurring in the reverse direction may be controlled by means of the design of the channel (or chamber), singly or in combination, in which flow in one direction is subjected to a greater resistance than it is in the opposite direction. In this instance, the channels (or chamber) can be designed to operate as valves that permit more flow in one direction than they do in another, while at the same time being capable of imparting the appropriate mixing actions to the materials. Alternatively, the amount of flow occurring in the reverse direction may be controlled by means of the design of the pumping actions in which a greater pumping effect is achieved in one direction than it is in the other. This backflow can have a beneficial effect in increasing the residence time within the mixing unit, thereby subjecting any part of the material to an increased number of mixing actions. In some embodiments of the invention there may be no net flow in any one direction during mixing so that the mixing operation is essentially static (the mixer could have a common inlet/outlet).

Apparatus in accordance with the present invention can be used to mix a single material (the term mixing in this context is used throughout the mixing industry referring to, for example, dispersive mixing of a material to break it down into smaller component parts which may be coupled with distributive mixing in distributing those smaller parts through the material as a whole) or a number of different materials including mixtures of fluids and solids, or indeed just solids which are capable of behaving in a manner analogous to fluids.

Embodiments of the present invention will now be described, by way of example only, with reference to the accompanying drawings, in which.

Figure 1:
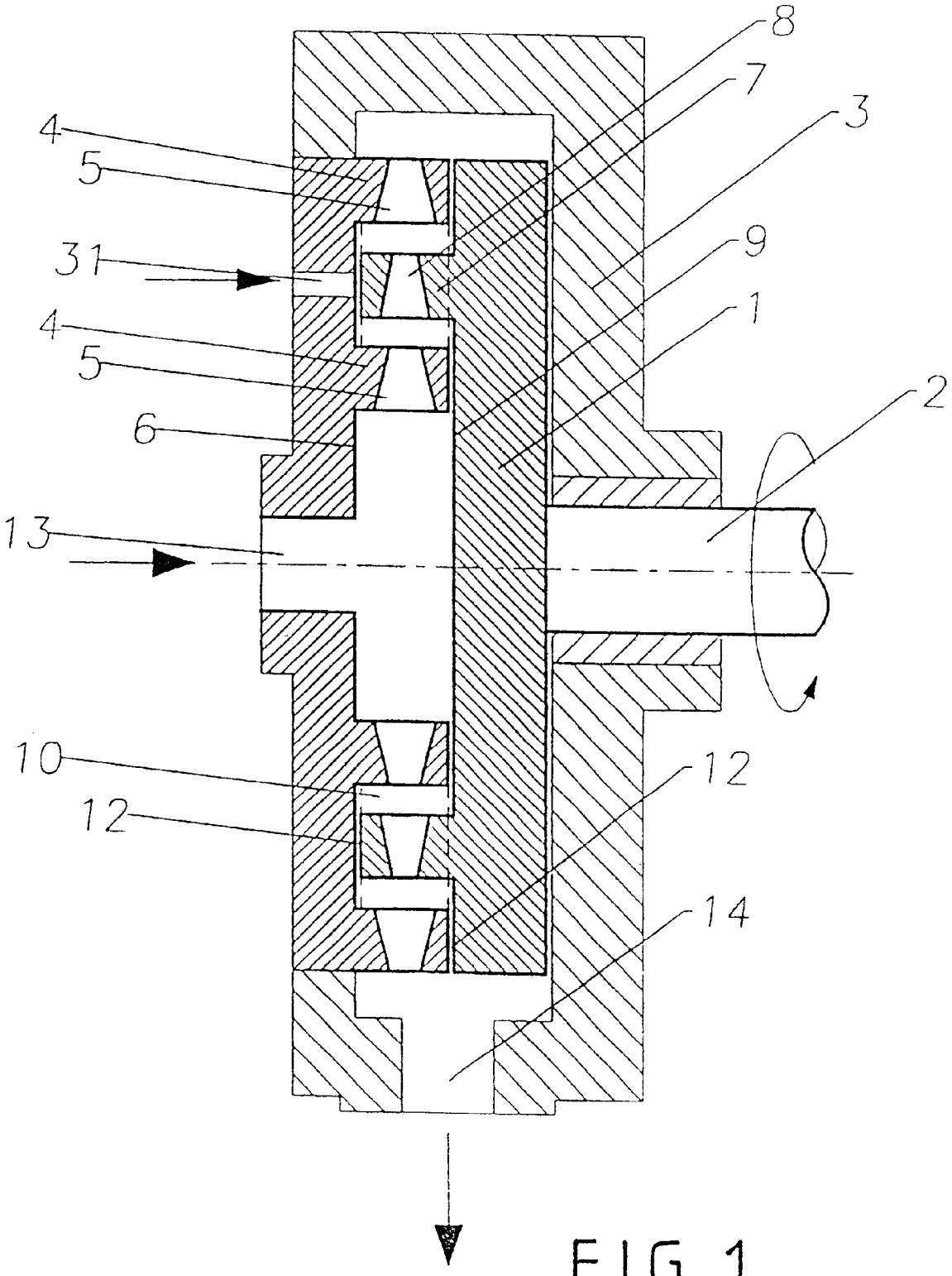
FIG. 1 is a sectional side-elevation of a mixing apparatus in accordance with a first embodiment of the present invention.
Figure 4:
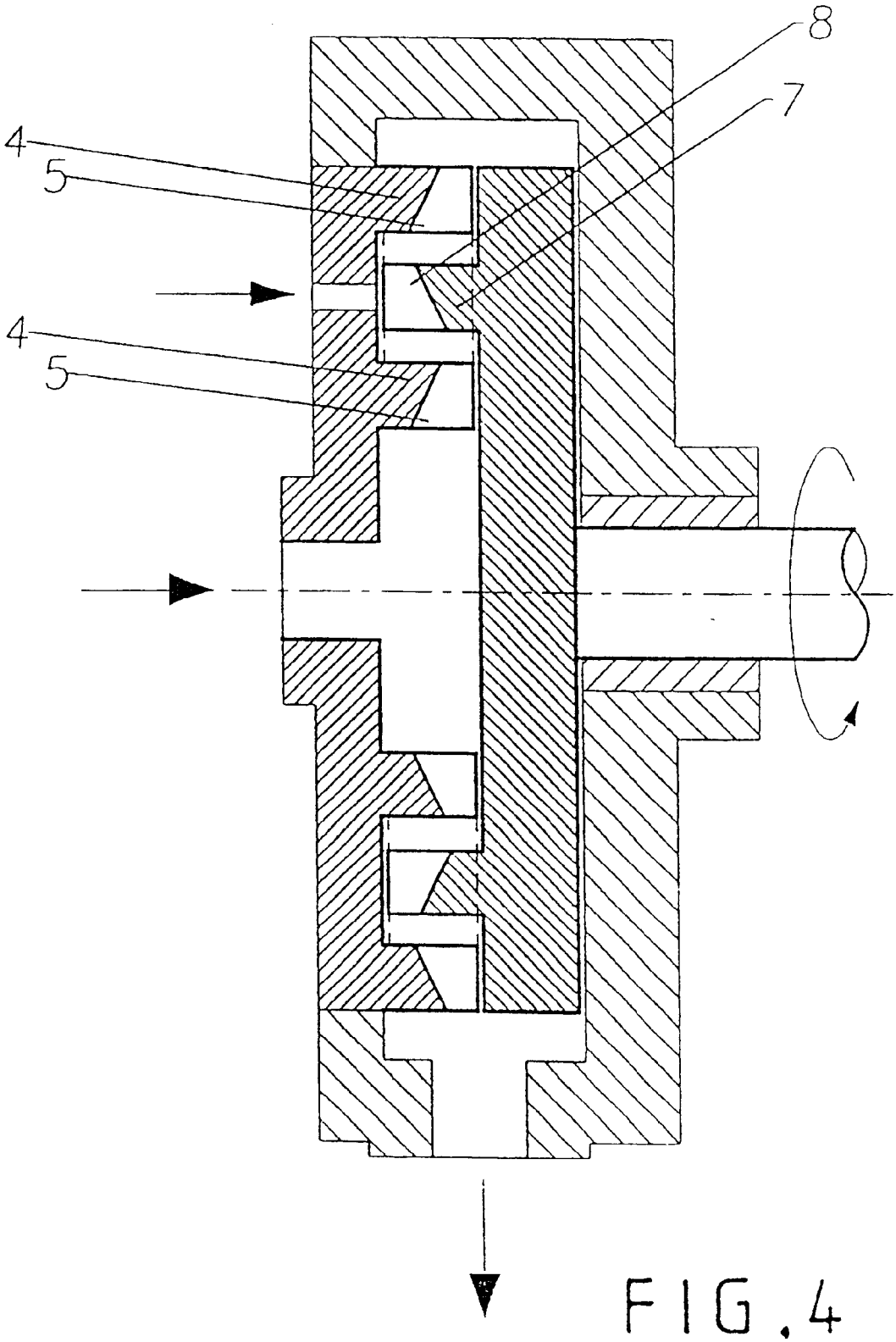

FIGS. 3*a*, 3*b*, 3*c*, 3*d*, 3*e* and 3*f* are illustrations to an enlarged scale of various alternative types of channel formation;

FIG. 4 is a section side-elevation illustrating a modification to the mixing apparatus of FIG. 1.

Figure 5:
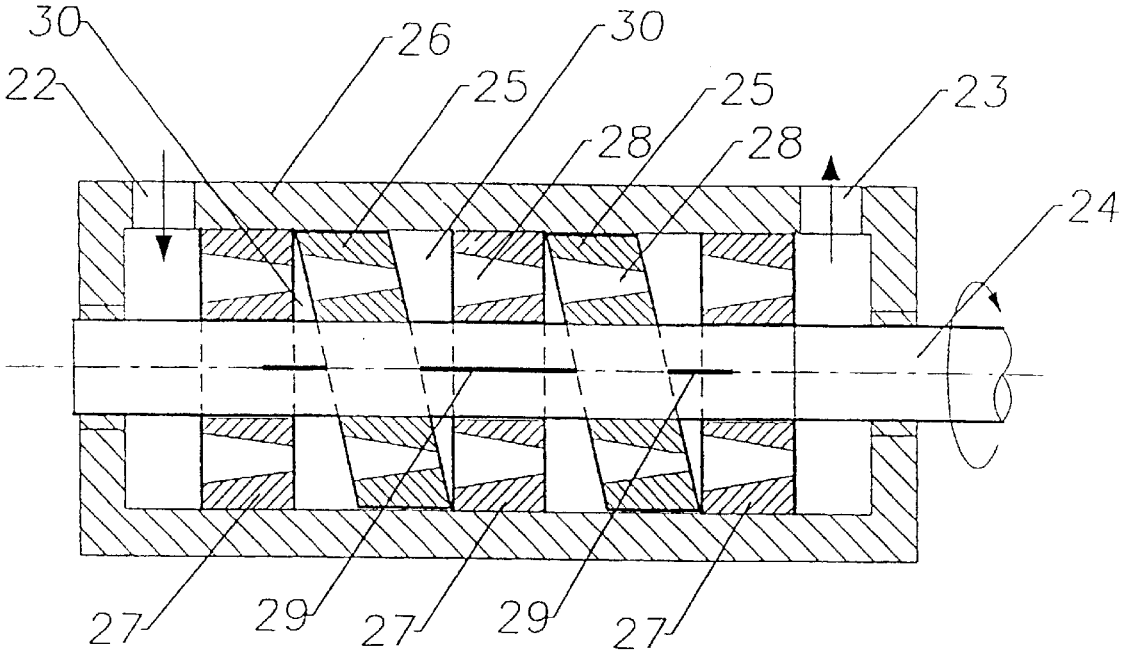
Figure 6:
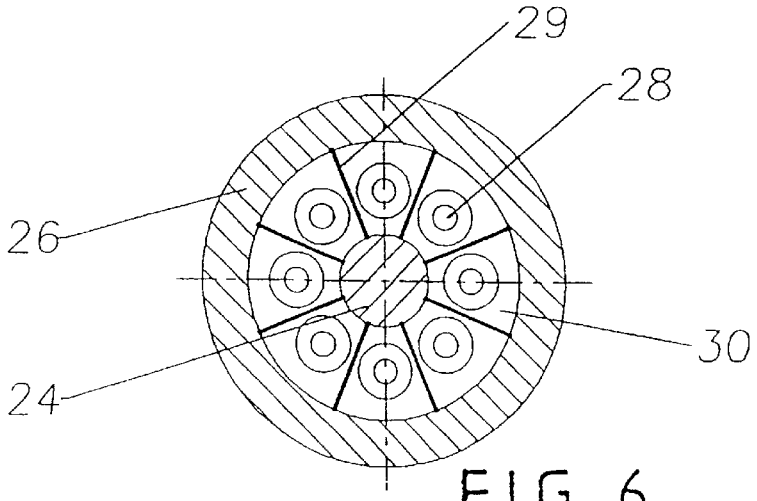

FIG. 5 is a sectional side-elevation of a third embodiment of the present invention; and FIG. 6 is a sectional end-view of the mixing apparatus of FIG. 5.

Figure 2:
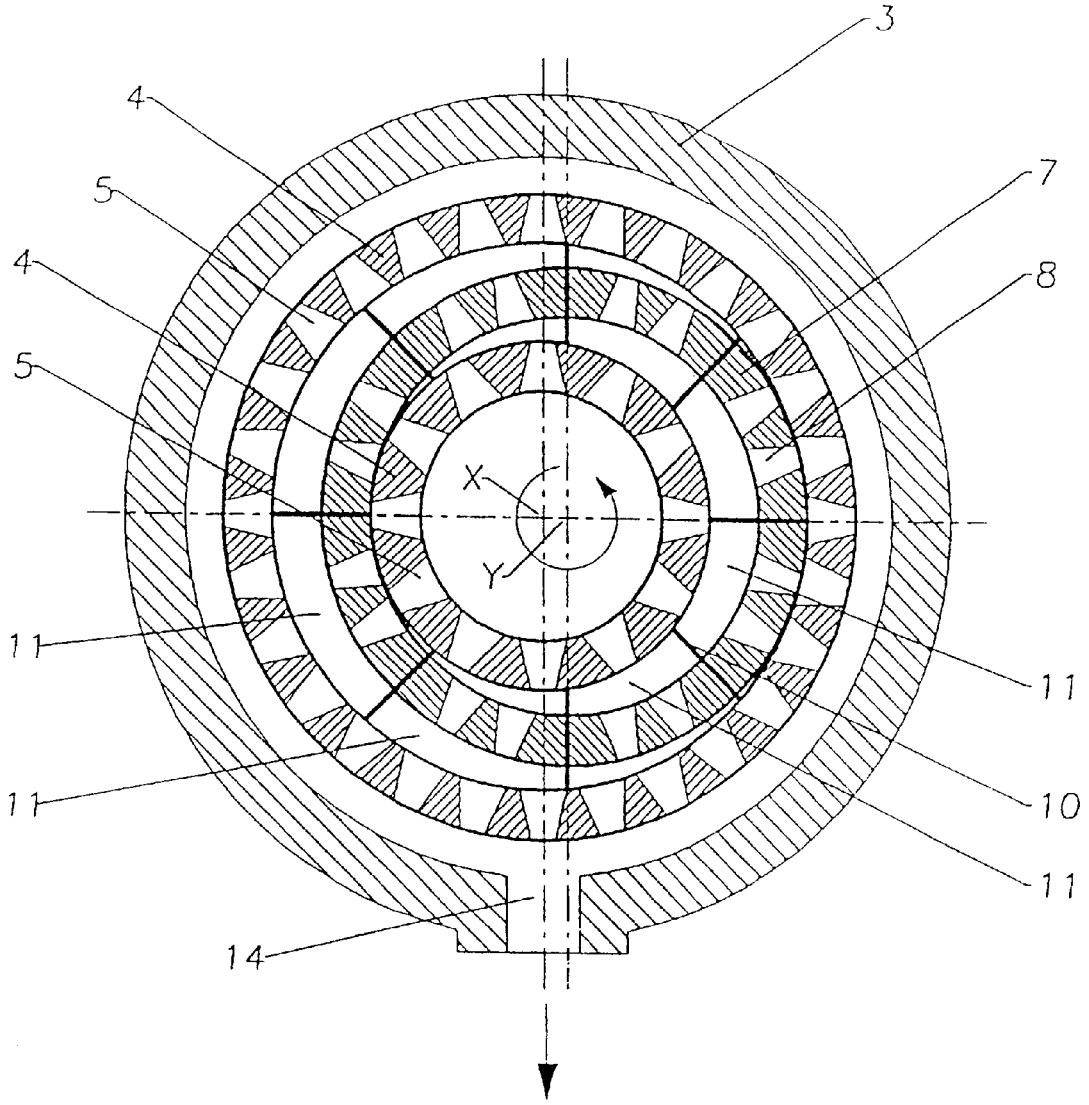
FIG. 2 is a sectional end-view of the embodiment of FIG. 1.

Referring to FIGS. 1 and 2, the illustrated mixer comprises a rotor 1 and rotor shaft 2, driven by some external means (not shown), mounted within a generally cylindrical housing 3 having an inlet 13 and outlet 14. Two fixed stator rings 4, each defining a set of radial stress-inducing channels 5, are mounted on a planar surface 6 supported within the housing 3 and are concentric with and perpendicular to an axis through point X (see FIG. 2). The rotor 1 comprises a single rotor ring 7 defining a set of radial stress-inducing channels 8 which is concentric with the rotor shaft 2 which has its axis through a point Y (see FIG. 2). The rotor ring 7 is supported on a planar surface 9 which is perpendicular to the rotor axis.

The axis of rotation of the rotor 1 is parallel to the axis of concentricity of the stator rings 4 and is offset from it by a distance XY, with the result that the rotor ring 7 rotates with an eccentricity relative to the stator rings 4. The rotor ring 7 carries a number of vanes 10 mounted between the outer surface of the inner stator ring 4 and the inner surface of the outer stator ring 4. The vanes 10 are capable of sliding radially with respect to the rotor ring 7 and circumferentially with respect to the stator rings 4 and extend axially to slide against the planar surface 9 of the rotor on one side and the planar surface 6 of the stator on the other side.

The combination of the surfaces of rotor ring 7, rotor planar surface 9, stator rings 4, stator planar surface 6 and vanes 10 serves to enclose a set of inner and outer compartments 11 on either side of the rotor ring 7 respectively within the annular chamber defined between the stator rings 4. That is, two compartments 11 are defined between each pair of neighbouring vanes 10, an inner compartment 11 between the rotor ring 7 and the inner stator ring 4 and an outer compartment 11 between the rotor ring 7 and the outer stator ring 4. As the rotor ring 7 rotates each compartment 11 rotates with it between respective vanes 10 and the volume of each compartment progressively increases and decreases as it rotates as a consequence of the eccentricity of the rotor ring 7 relative to the stator rings 4. A pumping action is thus provided in which material is drawn into each compartment 11 as it expands and is expelled as it contracts. The material enters and exits each compartment primarily through the channels 5 and 8 that are radially disposed within the adjacent rings, although a controllable amount of material flow can take place through annular spaces 12 between the rotor ring 7 and the stator planar surface 6 and between the stator rings 4 and the rotor planar surface 9.

In operation, material to be mixed enters through inlet 13 and is drawn radially through flow channels 5 in the inner stator ring 4 into expanding inner compartments 11 defined between the inner stator ring 4 and the rotating rotor ring 7. At the same time, contracting inner compartments 11 defined between the inner stator ring 4 and the rotor ring 7 pump material radially through the rotor ring flow channels 5 into outer compartments 11 defined between the rotor ring 7 and the outer stator ring 4. In addition to the pumping action of contracting outer compartments 1, material will also be drawn through the channels 5 as outer compartments 11 defined between the rotor ring 7 and outer stator ring 4 expand. Thus, material flows radially outwards through the rotor ring 7 between each pair of inner and outer compartments 11 defined between respective pairs of vanes 10 through a combination of contraction of the inner compartments 11 and expansion of the corresponding outer compartments 11. Similarly, as outer compartments 11 defined between the rotor ring 7 and the outer stator ring 4 contract material is pumped through channels 5 defined in the outer stator ring 4 to the annular part of outlet 14. In this way, material is continually pumped through the apparatus from inlet 13 to outlet 14 simply by rotation of rotor ring 7.

The cross-sectional areas of each of the channels 5 and 8 illustrated in FIGS. 1 and 2 converge in a radially outwards direction. This convergence within each channel 5/8 imposes extensional stresses and shear stresses on the material contained therein thereby subjecting the material to a combination of extensional-dispersive and shear-dispersive mixing. The amount of stressing is related both to the geometry of each channel 5 and 8 and to the flowrates arising from the pressure differentials imposed across each channel 5 and 8. For instance, the geometry of the channels can be selected to vary the degree of extensional and/or shear stressing. For instance, the channels could be figured so that extension stresses are effectively reduced to zero so that only shear-dispersive mixing occurs within the channels 5 and 8.

In addition to the extensional-dispersive and shear-dispersive mixing provided by the channels 5 and 8, there is also distributive mixing as the material passes between the stator rings 4 and rotor ring 7. That is, each inner compartment 11 receives material from each channel 5 of the inner stator ring in sequence and thus each channel 8 in the rotor ring 7 receives material from each channel of the inner stator ring. Moreover, material passing from each outer compartment 11 to the annular part of the outlet 14 is distributed amongst each of the channels 5 of the outer stator ring 4 as the respective compartments 11 rotate. Thus, material entering through inlet 13 is distributed through all channels 5 in the inner stator ring, material passing through each channel 5 in the inner stator ring 4 is then distributed amongst all channels of the rotor ring 7, and material passing through each channel 8 in the rotor ring 7 is distributed amongst all channels 5 of the outer stator ring 4.

There will also be some degree of shear-dispersion occurring within the compartments 11 by virtue of rotation of the rotor ring 7 relative to the stator ring 4, and some extensional dispersive mixing as a result of the "tapering" geometry of the compartments 11.

In addition, although the net flow through the mixer is from the inlet to the outlet 14 as described above, it will be appreciated that as each compartment 11 contracts there will be a pumping force both radially inward and outward and similarly as each compartment 11 expands it will draw in material from both radially outer and radially inner parts of the mixer. This is also beneficial. In more detail, the material flow through each channel 5/8 illustrated in FIGS. 1 and 2 is greater in the radially outward direction than it is in the radially inward direction as a result of the interaction between the geometry of the channels and the material. This interaction is a function of a number of aspects including material viscosity, material-surface effects, and the magnitude and direction of flow velocities. The radially-outward bias results in the net flow of material in a radially outward direction, from an inlet 13 to an outlet 14 of the mixer. However, because the material is capable, within the geometry illustrated, of also flowing radially-inward during part of each revolution of the rotor 1, an amount of back-mixing is obtained in which the material is subjected to the mixing actions in the reverse direction. This back-mixing operation serves to increase the residence time of the material within the mixer and especially to increase the amount of active mixing taking place, as any part of the material passing through the mixer is subjected to more passes through the mixing elements than would be achieved if totally efficient pumping were to be used. However, the design illustrated is required to achieve a balance between the pumping efficiency required to propel material through the channels in order to achieve the required amounts of dispersive mixing, and the pumping inefficiency desired to achieve the required residence time within the mixer.

Figure 3A:
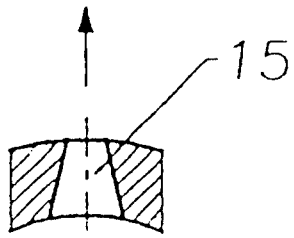
Figure 3B:
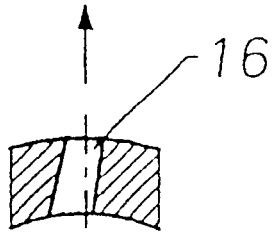
Figure 3C:
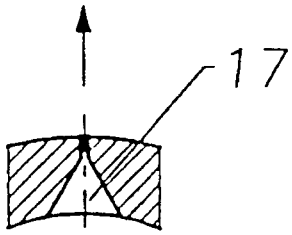
Figure 3D:
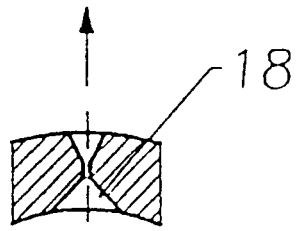
Figure 3E:
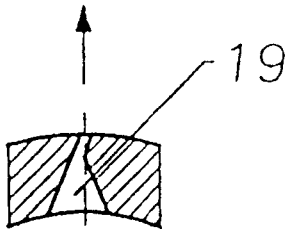
Figure 3F:
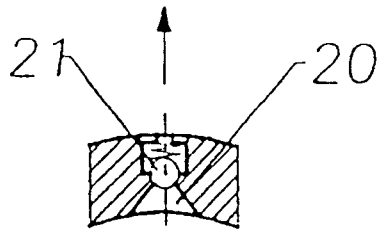

The directional bias of the material flow through the mixer illustrated in FIGS. 1 and 2 can therefore be affected significantly by the design of the channels. FIGS. 3*a* to 3*f* illustrate some alternative channel designs, in which the direction of the material flow is required to be predominantly upwards in the direction of the arrows shown. FIG. 3*a* shows a radially convergent channel 15 of the type illustrated in FIGS. 1 and 2. FIG. 3*b* shows a slanted channel 16 in which the direction of rotation of the disk affects the directionality of flow within the channel. FIG. 3*c* shows a radially convergent channel 17 in which the surface area of the inner end is larger than that of the outer end, thereby imposing a greater resistance to flow in one direction than in the other. FIG. 3*d* shows a pair of radially convergent/divergent channels 18 in which the surface area of the inner end is larger than that of the outer end, thereby imposing a greater resistance to flow in one direction than in the other. FIG. 3*e* shows a radially convergent channel 19 with a slant in which the direction of rotation of the disk affects the directionality of flow within the channel. FIG. 3*f* shows a channel 20 with a spring-loaded ball valve 20 in which the ball seats against an orifice to prevent flow in the radially inward direction, while moving off the seat against spring pressure to permit flow in the radially outward direction. The configurations depicted in these Figures are by way of examples only and it will be appreciated that other design configurations are possible. For example, many alternative valving actions to induce or impart a preferential flow direction may be used, such as positive-valving or gating techniques of the diaphragm valve type, or vortex-inducing techniques or fluid amplification techniques.

Within the general configuration shown in FIGS. 1 and 2 it is also feasible to establish a preferential flow direction across the mixer by means of placing and sizing the channels 5 and 8 at the appropriate positions. For instance, for any expanding compartment 11 channels within the adjacent inner ring could be sized greater than the channels within the adjacent outer ring, whereas for any contracting compartment 11 the converse applies. An alternative arrangement for high pumping efficiency would be not to locate any channels within the outer ring adjacent to an expanding compartment, nor within the inner ring adjacent to a contracting compartment.

With reference to FIGS. 1 and 2 it may be noted that the radial channels 5 and 8 are shown to be totally enclosed within the rotor ring 7 and each stator ring 4 respectively. An alternative arrangement is shown in FIG. 4 in which each channel 5 and 8 is defined in the axially outer edge of respective ring 4 and 7. Each channel is not therefore totally enclosed within its respective ring but is bounded on at least one side by the adjacent planar surface 6 or 9. It may be noted that the sectional end-view shown in FIG. 2 is valid for FIG. 4, as are the general channel formations exemplified in FIG. 3.

It may also be noted that a channel is not confined to being circular in cross-section down its axis: for instance, a cross-section that is curved but not circular, such as an oval section, or a cross-section that has one or more flat or straight sides, such as a rectangular section, are also valid as embodiments of the invention. Indeed, the use of non-circular cross-sections of the latter types may simplify manufacture of the equipment and may also provide additional mixing benefits such as enhanced shear stressing and extensional stressing as a result of additional degrees of freedom being introduced into the geometry of the channel and into the flow characteristics of the material within the channel.

As a further alternative modification, the channels 5 shown in FIG. 4 could be formed essentially continuous in a circumferential direction so as to form an annulus, i.e. a single annular stress-inducing flow channel (which in this embodiment is partitioned by the vanes 10).

In another example of an embodiment of the invention, FIGS. 5 and 6 depict a mixing system having a predominantly axial flow, with the material entering at an inlet port 22 and exiting at an outlet port 23. The mixer in this example comprises a rotor shaft 24, rotationally driven by some external means (not shown), on which two rotor discs 25 are concentrically located, mounted within a housing 26 that contains three concentrically located stator discs 27. Each rotor and stator disc contains axially-aligned stress-inducing flow channels 28, for instance of the types shown in FIG. 3, where each channel is either totally enclosed within its respective disc or alternatively is located within the circumferential surface of the disk with the inner surface of the housing forming the enclosing surface. In this example, the stator disks 27 are mounted on planes that are perpendicular to the axis of rotation of the rotor shaft 24, while the rotor disks 25 are located on planes that are inclined with respect to the planes of the stator disk 27. The rotor disks 25 are shown to be parallel to each other, although this is not essential and alternative arrangements are equally possible.

Each stator disk 27 contains a number of vanes 29 mounted between the outer surface of the rotor shaft 24 and the inner surface of the housing 26, and which are capable of sliding axially with respect to the surface of the rotor 24 and circumferentially with respect to the housing 26. The vanes 29 extend axially from within slots located in the stator disks 27 to slide against the face of the rotor disks 28.

The combination of the surfaces of rotor discs 25, stator discs 27, rotor shaft 24, housing and vanes 29 serves to enclose a set of compartments 30. As the rotor disks 25 rotate, each compartment becomes progressively larger and smaller as a consequence of the non-parallelity of the rotor discs 25 relative to the stator discs 27. A pumping action is thus provided in which material is drawn into each compartment 30 as it expands and is expelled from the compartment as it contracts. The material enters and exits each compartment through the channels 28 that are axially disposed within the adjacent discs, although a controllable amount of material flow can take place through annular spaces defined between the rotor disks 25 and the housing 26 and thereby provide a degree of mixing within spaces other than the channels 28.

It will be appreciated that in the geometry shown in FIG. 5 the vanes 29 may or may not seal each compartment 30 along the line of sliding action between each vane and an inclined surface of each rotor disc 25 depending upon the construction of the individual vanes and the degree to which circumferential transfer flow between adjacent compartments 30 is desired for mixing (for instance, each vane could comprise a number of adjacent independently slideable sections).

In operation, the material passing axially from each channel 28 is substantially distributed in sequence, via the compartments 30 between stator disks 27 and rotor disks 25, to the channels 28 contained within the adjacent discs. The resultant dispersive and distributive mixing actions is similar to those previously described in the example of radially-flowing mixing of FIGS. 1 and 2.

The axially-flowing mixer of FIGS. 5 and 6 thus serves to illustrate the wide range of potential embodiments of the invention, where pumping actions are combined with mixing actions within the mixer unit. The pumping actions are not however limited to the vane types described within these examples, but can equally comprise other forms of pumping such as, but not limited to, those embodying alternative means of positive displacement pumping, centrifugal pumping or drag-flow pumping. Indeed, with the embodiments of FIGS. 1, 2 and 4, a certain amount of centrifugal pumping will occur in addition to the pumping actions described above as a result of rotation of the rotor ring 7. The degree of centrifugal pumping will depend upon the design of the mixer and the material being mixed and could be relatively substantial in cases of low viscosity materials and high rotational speeds.

As an example of alternative pumping actions that may be incorporated in mixers in accordance with the present invention, the mixers of FIGS. 1, 2 and 4 could readily be modified to provide centrifugal pumping only by removing the vanes. With such an arrangement, as the rotor ring 7 is rotated, material contained within each radial flow channel would be subjected to centripetal forces which would propel the material in a radially outwards direction. A pumping action would thereby be provided in which material would be drawn from the upstream stator flow channels 5 and chamber to the rotor flow channels 8 and then expelled into the outer (downstream) chamber and stator flow channels 5. There could also be a controllable amount of material flow through the annular spaces 12 between the rotor ring 7 and the stator planar surface 6 and between the stator rings 4 and the rotor planar surface 9.

It will be appreciated that with such a centrifugal pumping mixer the material present in the chambers defined between the rotor ring and stator rings will be subjected to rigorous shearing actions between the rotor ring 7 and the stator rings 4 and also extensional flow due to the circumferential tapering of the chambers, in addition to the stressing that occurs within the stress-inducing channels (the degree of stressing being influenced in part by the relative dimensions of the chambers). Alternatively, the stator and rotor rings could be mounted concentrically with one another (i.e. effectively reducing the XY offset to zero) in which case there will still be centrifugal pumping but no significant extensional-dispersive mixing within the chambers which would no longer taper (if desired vanes could be included in such an embodiment to enhance distributive mixing). As a yet further modification, the concentric stator and rotor rings could be sized so that they are in sliding contact with one another.

It will be appreciated that many of the design details and operational details discussed in relation to the vane-type mixers of FIGS. 1, 2 and 4 apply equally to the centrifugal pumping modification discussed above.

As a further alternative, the mixers of FIGS. 1, 2 and 4 could be modified to provide drag-flow pumping. In this case, the eccentric mounting of the stator ring 7 may be maintained but the vanes would preferably be omitted. As the rotor ring 7 rotates eccentrically relative to the stator rings 4 the annular chambers defined therebetween would contain an expansion zone and a compression zone. Provided the material to be mixed has a sufficiently high viscosity, the drag forces imparted to the material by the motion of the rotor 7 would be sufficient to pump material out from the compression zone through the adjacent radial flow channels. With an arrangement similar to that shown in FIG. 2, a series of alternating compression and expansion zones are effectively provided in any radial direction. Given that the radial flow channels 5 and 8 are capable of biasing the radial flow in favour of one direction over the other, a net flow of material through the mixer would be obtained.

Alternative constructions utilising other pumping mechanisms (or combinations of pumping mechanisms) could readily be constructed by the appropriately skilled person.

It may be noted that the examples of the mixers shown depict a limited number of mixing stages. It is an aspect of the present invention that more than one stage of mixing may be provided by means of additional rotor and stator stages, or that less stages could be provided by, for example, by reducing the number of rings to one stator ring and one rotor ring. For example, the radially-flowing mixer shown in FIG. 1 comprises two stator rings and one rotor ring. To this number may be added a further number of rotor and stator rings, where each stator ring is generally concentric with the other stator rings and lies on the same plane of the stator disk, where each rotor ring is generally concentric with the other rotor rings and lies on the same plane of the rotor disk, and where the rotor rings and the stator rings form alternate layers in the radial direction in the general manner shown in FIG. 1. Another example can be taken with reference to FIG. 4, where two rotor rings and three stator rings are shown. Additional numbers of rotor and stator rings can be added to the unit at locations along the axis of rotation of the rotor, where rotor disks and stator disks are alternately located along the axis.

It is thus shown that the invention allows for a number of mixing stages within a single mixing unit. It is another aspect of the invention that any individual stage need not contain the same volume of material as any other stage. This variation in volume is exemplified in FIG. 2, where the volume of material contained within the annular chambers defined between successive rings increases in the radial direction as a consequence of the increasing diameter of the rings. This feature is of importance when considering the performance of the mixing system in operating with additional streams of material, such as dilutant fluids, that are introduced into the mixing system after or before specific stages in the mixing operation. For instance, in a multi-stage mixer of the type shown in FIG. 1, the first stage could be used to achieve some initial mixing of the materials that entered the mixing system through the inlet, whereas the addition of material at an injection point 31 located within the second stage would permit such material to be mixed together with the initially mixed material and passed to the outlet port. The feature of expanding volumes of subsequent stages enables the mixing system to cope with increasing volumes of material without significantly altering the individual mixing actions that the material is being subjected to in successive mixing stages.

As an alternative aspect of the ability of the mixing system to provide volumes that differ from stage to stage, the reverse situation can be applied to the radially-flowing mixing system described in the preceding paragraph, namely that a flow in the reverse direction, that is radially inwards, can be used in situations such as those in which material is to be extracted from the mixer at intermediate stages. In this it should be noted that the reversal of the flow direction would be achieved by reversing the pumping effects by means of reversing the orientation of the channels previously described.

It is also a feature of the present invention that the pumping and mixing performances of an individual mixing unit can be varied before or during operation by means of adjusting the rotational speed of the rotor or the geometry of the mixer unit, more specifically the geometrical relationship of rotor to stator. For example, the amount of eccentricity of rotor to stator in the radial-flowing mixer of FIGS. 1 and 2 affects the pumping rate and hence the mixing effectiveness: this eccentricity can be set permanently, thereby establishing the ultimate performance of the mixer, or temporarily, in which the relative pumping performance and hence mixing performance can be set. In the example shown in FIG. 2, this temporary adjustment would require the axis of the rotor to be moved closer towards the axis of the stator, thereby reducing the pumping effectiveness of the unit but, for example, possibly enhancing its distributive mixing capability. In the example shown in FIGS. 5 and 6, the variations to performance could similarly be achieved by altering the inclination of the rotor disks with respect to the stator disks.

The invention has application in all areas of fluid mixing and across all industries where mixing is required, for example the chemical, food, healthcare, medical, petrochemical and polymer industries. The invention also has application in areas of solids mixing where such solids can be considered to respond to the imposed forces in an essentially fluid-like manner, or where the solids are fragmented to the extent that, in the aggregate, they are capable of behaving in a manner analogous to fluids, or any combination of fluids and solids.

What is claimed is:

1. A mixing apparatus for mixing a material, the apparatus comprising one or more stress inducing flow channels and at least two members eccentrically mounted one within the other so as to define a chamber therebetween, and which are rotateable relative to one another to thereby produce a pumping force to force material through said flow channels and chamber to thereby subject the material to stresses within at least one of said flow channels and said chamber that results in at least an extensional-dispersive or a shear-dispersive mixing.

2. A mixing apparatus according to claim 1, comprising a plurality of flow channels provided in at least two sets defined by respective channel members at least one of said flow channels being a said stress inducing flow channel, the channel members being arranged such that material is pumped from the or each flow channel of one set to the flow channel or channels of another.

3. A mixing apparatus according to claim 2, comprising more than two sets of said flow channels arranged to receive material in sequence, wherein a pumping force is imparted to the material between each set of flow channels.

4. Apparatus according to claim 2, wherein each set of flow channels comprises a plurality of stress-inducing channels.

5. Apparatus according to claim 4, wherein the flow channels are arranged such that material pumped from each channel of one set of flow channels is distributed between a number of flow channels of another set of flow channels to achieve distributive mixing.

6. Apparatus according to claim 5, wherein the channels are arranged such that each channel of one set of flow channels receives material from a plurality of flow channels of another set of flow channels to further promote interleaving and distributive mixing of the material.

7. Apparatus according to claim 2, comprising a plurality of pairs of said channel members, each pair defining a respective chamber therebetween, wherein the volumes of the respective chambers vary between successive pairs of channel members to permit material to be drawn off from, or added to, the mixing apparatus at intermediate stages of mixing without adversely affecting the pumping performance of the apparatus.

8. Apparatus according to claim 2, wherein the volume of said flow channels varies between successive pairs of channel members to permit material to be drawn off from, or added to, the mixing apparatus at intermediate stages of mixing without adversely affecting the pumping performance of the apparatus.

9. A mixing apparatus according to claim 2, comprising a plurality of pairs of said channel members each pair defining a respective chamber therebetween, and one or more partition members extending between adjacent channel members to partition the respective chamber, wherein a space is defined between the or each partition member and an adjacent wall of a channel member, and wherein the size of said spaces varies between successive chambers defined between successive pairs of channel members to permit material to be drawn off from, or added to, the mixing apparatus at intermediate stages of mixing without adversely affecting the pumping performance of the apparatus.

10. A mixing apparatus according to claim 2, wherein one or more channels of each set of flow channels are defined partly by said respective channel member and partly by another member which may be an adjacent channel member.

11. A mixing apparatus according to claim 2, wherein at least one of said at least two members comprises one of said channel members.

12. A mixing apparatus according to claim 2, wherein the at least two channel members are positioned relative to one another so as to define said chamber therebetween, said chamber comprising at least one compartment through which the material passes between two sets of flow channels, wherein in operation the volume of the or each compartment successively increases and decreases to provide positive displacement pumping.

13. A mixing apparatus according to claim 12, wherein one of said at least two channel members is mounted for rotation relative to the other, the rotating channel member carrying one or more partition members extending between said at least two channel members to partition said chamber and define said at least one compartment such that said at least one compartment rotates with the rotating channel member, and wherein the geometry of said chamber is such that the volume of said at least one compartment progressively increases and decreases as it rotates, the volume of said at least one compartment being determined by its angular position.

14. A mixing apparatus according to claim 13, wherein the at least two channel members are at least substantially annular with successively increasing diameters and are arranged such that one channel member surrounds another.

15. A mixing apparatus according to claim 14, wherein the at least two channel members are arranged in one or more pairs, the channel members of the or each pair being eccentrically mounted relative to one another.

16. A mixing apparatus according to claim 14, wherein said at least two channel members are arranged in one or more pairs, one channel member of the or each pair of channel members being fixed in position.

17. A mixing apparatus according to claim 14, comprising at least three of said channel members two of which are concentric and fixed in position and the third of which is mounted for eccentric rotation between the other two.

18. A mixing apparatus according to claim 14, comprising at least three of said channel members two of which are concentric and rotate about a third channel member which is fixed in position between them.

19. A mixing apparatus according to claim 12, wherein at least some of said flow channels are configured to favor flow in a downstream direction such that on alternation of the direction of pumping to provide backflow there remains a net downstream flow.

20. A mixing apparatus according to claim wherein at least some of said flow channels are provided with valve means which favor flow in the downstream direction.

21. A mixing apparatus according to claim 12, wherein one of said at least two channel members is mounted for rotation relative to the other which does not rotate, the non-rotating channel member carrying one or more partition members extending between said at least two channel members to partition said chamber and define said at least one compartment, and wherein the geometry of said chamber is such that the volume of said at least one compartment progressively increases and decreases as the rotating channel member rotates, the volume of said at least one compartment being determined by the angular position of the rotating channel member.

22. Apparatus for mixing a material, the apparatus comprising one or more flow channels defined by each of at least two channel defining members which are axially mounted within a housing, at least one of said flow channels being a stress-inducing flow channel, at least one of said channel members being rotateable on a shaft which extends to the other such that a chamber and an enclosing volume is defined between the two channel members around said shaft and an inner surface of said housing, one of the channel members being provided with one or more partition members extending between the two channel members to partition said chamber into two or more compartments, and wherein said channel members have non-parallel facing surfaces such that as the rotating channel member rotates, a respective volume of each compartment progressively increases and decreases as a function of its annular position about said shaft.

23. Apparatus according to claim 22, wherein said channel members are substantially disc shaped and adjacent channel members are angled relative to one another to produce said non-parallel faces.

24. Apparatus according to claim 22, comprising at least three channel members mounted about said shaft, two of said channel members being fixed in position and a third being rotatable between the other two.

25. Apparatus according to claim 22, wherein said housing is generally cylindrical such that the or each chamber is defined in part by a wall of the housing.

26. Apparatus according to claim 22, wherein each channel member defines a plurality of said stress inducing channels.

27. Apparatus according to claim 26, wherein said flow channels are arranged such that material pumped from each channel of a first of said channel members is distributed between a plurality of channels of a second of said channel members to thereby achieve distributive mixing.

28. Apparatus according to claim 27, wherein the flow channels are arranged such that each channel defined by a first of said channel members receives material from a plurality of channels defined by a second of said channel members to further promote interlieving and distributive mixing of the material.

29. Apparatus according to claim 22, comprising a plurality of pairs of said channel members defining respective chambers therebetween, wherein the volumes of the respective chambers vary between successive pairs of channel members to permit material to be drawn off from, or added to, the mixing apparatus at intermediate stages of mixing without adversely affecting the pumping performance of the apparatus.

30. Apparatus according to claim 22, wherein the volume of said flow channels varies between adjacent channel members to permit material to be drawn off from, or added to, the mixing apparatus at intermediate stages of mixing without adversely affecting the pumping performance of the apparatus.

31. Apparatus according to claim 22, wherein said flow channels are configured to favor flow in a downstream direction such that on alternation of the direction of pumping to provide backflow there remains a net downstream flow.

32. Apparatus according to claim 31, wherein at least some of said flow channels are provided with valve means which favor flow in said downstream direction.

33. Apparatus according to claim 22, comprising at least three channel members mounted about said shaft, two of said channel members being rotatable about a third which is fixed to said shaft.

* * * * *